US005098327A

United States Patent [19]

Ferrero

[11] Patent Number: 5,098,327

[45] Date of Patent: Mar. 24, 1992

[54] COMBINATION GIFT AND ITS CASING

[75] Inventor: Pietro Ferrero, Brussels, Belgium

[73] Assignee: Ferrero S.p.A., Alba, Italy

[21] Appl. No.: 587,475

[22] Filed: Sep. 21, 1990

Related U.S. Application Data

[63] Continuation of Ser. No. 330,217, Mar. 29, 1989, abandoned.

[30] Foreign Application Priority Data

Apr. 13, 1988 [IT] Italy ..... 67343 A/88

[51] Int. Cl.[5] ..... A63H 33/04; A63H 33/16; A63H 33/00

[52] U.S. Cl. ..... 446/75; 446/79; 446/80; 446/487

[58] Field of Search ..... 446/4, 5, 6, 71, 72, 446/73, 74, 75, 76, 79, 80, 81, 82, 87, 88, 385, 386, 387, 369, 487, 488, 489, 490, 491

[56] References Cited

U.S. PATENT DOCUMENTS

| | | | |
|---|---|---|---|
| 1,544,645 | 7/1925 | Johnson | 446/387 |
| 1,757,243 | 5/1930 | Goldberg | 446/488 |
| 1,827,964 | 10/1931 | Amsden | 446/387 X |
| 2,032,531 | 3/1936 | Eaton | 446/80 |
| 3,567,013 | 3/1971 | Tannenbaum | 206/538 |
| 3,634,965 | 1/1972 | McAuley | 446/88 |
| 3,808,732 | 5/1974 | Gay et al. | 446/75 |
| 4,140,317 | 2/1979 | Ramney | 446/80 X |
| 4,349,983 | 9/1982 | Kilroy et al. | 446/75 |
| 4,433,504 | 2/1984 | Terui | 446/75 |
| 4,575,348 | 3/1986 | Wiggs et al. | 446/487 X |
| 4,581,904 | 4/1986 | Lehmann et al. | 446/73 X |
| 4,690,654 | 9/1987 | DeLaney | 446/75 X |
| 4,696,652 | 9/1987 | Reeder et al. | 446/75 |
| 4,853,994 | 8/1989 | Ekstein | 446/75 X |
| 4,865,574 | 9/1989 | Kobayashi | 446/72 |

FOREIGN PATENT DOCUMENTS

| | | | |
|---|---|---|---|
| 652819 | 11/1962 | Canada | 446/76 |
| 700976 | 12/1964 | Canada | 446/75 |
| 1129406 | 5/1962 | Fed. Rep. of Germany | 446/73 |
| 1409814 | 7/1965 | France | 446/73 |
| 2559072 | 8/1985 | France | 446/487 |
| 113270 | 3/1926 | Switzerland | 446/80 |
| 2118851 | 11/1983 | United Kingdom | 446/72 |
| 2120111 | 11/1983 | United Kingdom | 446/72 |

*Primary Examiner*—David N. Muir
*Attorney, Agent, or Firm*—Rothwell, Figg, Ernst & Kurz

[57] ABSTRACT

A combination gift (a surprise) and its casing are disclosed which are formed essentially as a single unit, for example of molded plastic material. After the combination's formation, the gift, or its constituent parts, can be folded into the casing which is then closed. Furthermore, forming the combination as a single unit enables the packaging of the unit to be carried out completely automatically.

8 Claims, 1 Drawing Sheet

COMBINATION GIFT AND ITS CASING

This is a continuation of application Ser. No. 07/330,217, filed Mar. 29, 1989, now abandoned.

BACKGROUND OF THE INVENTION

1. Field of the Invention

The present invention relates to combinations constituted by a gift or surprise and its casing of the type currently used, for example, for inserting gifts in chocolate eggs and like hollow food products, within the closure elements of jars, etc. . . . .

2. Description of the Prior Art

In a currently-used solution, the gift or surprise, which is usually constituted by several parts which are intended to be assembled to form a small toy, constitutes an element which is separate from the casing (barrel) which is intended to receive it.

During the packaging stage, it is therefore necessary to insert the gift in the casing, which is usually constituted by two cup-shaped bodies, or by a cup-shaped body closed by a flat lid whose free edges can be snap interengaged.

The packaging operation has, therefore, to be carried out manually and, as well as having an adverse effect on the cost of the combination and of the product in which it is inserted, in practice this also prevents the packaging from being carried out in a controlled atmosphere, which would be desirable to ensure the hygiene of the final product.

The object of the present invention is to provide a combination comprising a gift (surprise) and its casing which can be packed-completely automatically.

SUMMARY OF THE INVENTION

According to the present invention, this object is achieved by virtue of a combination comprising a gift (surprise) and its casing, characterised in that the gift and its casing are formed essentially as a single unit, the gift being able to be placed in the casing.

The casing can be produced so as to itself constitute, at least in part, a component of the gift.

According to a preferred solution, the gift may be constituted by several parts which can be assembled together, the parts being formed as appendages of the casing.

According to a particularly preferred embodiment, the casing comprises at least one body with a respective free edge and the gift is formed, at least partly, as appendages which extend from the free edge and can be folded inwardly of the body.

The casing is usually constituted by two complementary bodies (for example two bowl-shaped half shells or a cup-shaped shell of flattened shape closed by a flat cover) which are interconnected in a generally-hinged arrangement along homologous portions of their respective free edges.

In a further aspect of the present invention, a method is disclosed for packaging a combination, comprising a gift and its casing, of the type specified above, characterised in that it comprises the steps of:

(a) forming the gift and its casing essentially as a single unit, (b) placing the gift in the casing, and (c) closing the casing around the gift.

As already indicated above, this method can be carried out completely automatically, possibly in a controlled environment.

BRIEF DESCRIPTION OF THE DRAWINGS

This invention will now be described, purely by way of non-limiting example, with reference to the appended drawings, in which.

DESCRIPTION OF THE PREFERRED EMBODIMENTS

Figure 1:
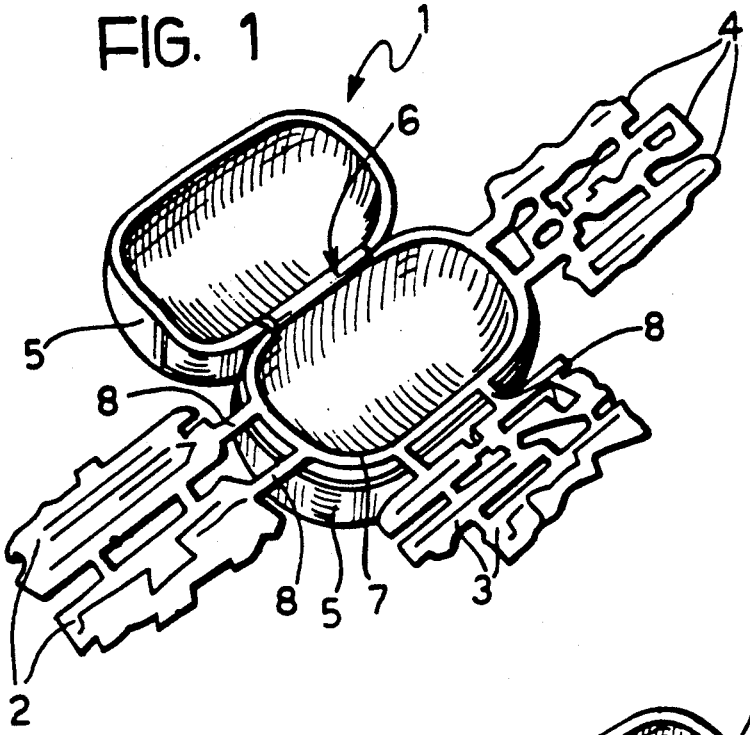
FIG. 1 is a perspective view which shows a combination comprising a gift (surprise) and its casing according to the invention.

In the drawings, a combination, generally indicated by numeral 1, comprises the following:

a gift (surprise) constituted by a plurality of components 2, 3, and 4 which are intended to be fitted together, and a casing constituted by two complementary bowl-shaped bodies 5 which are connected in a generally hinged arrangement by a flexible sheet 6 which extends so as to connect homologous portions of the free edges of the two bowl-shaped bodies 5.

The gift included in the combination according to the invention is usually constituted by a small toy (for example a small aeroplane, car, etc.) which is intended to be formed by the snap-assembly of its constituent parts 2, 3 and 4.

This is, in itself, a widely-known solution in general use in so-called "surprises" which are inserted in chocolate eggs and in food packages. The presence of the surprise within the product is an attraction to the potential purchaser, particularly to children who, when they have opened the egg or package, reach the surprise container and can assemble the surprise itself.

The essential characteristic of the combination 1 of the invention is the fact that the components 2, 3 and 4 which form the gift are not separate from the package 5.

On the contrary, the gift 2, 3 and 4 and its casing 5 constitute—essentially—a single unit, for example of moulded plastics material.

The term—essentially—as used above and in the claims which follow is intended to mean that not necessarily all the components constituting the gift and all the parts constituting the casing form a single unit. For example, it is possible (and included within the scope of the present invention) for some of the components of the gift to form a unitary element with a respective portion of the casing, whilst other components in turn form a unitary element with another part of the casing. Similarly, a solution may be envisaged in which the gift includes an additional component (for example a component of a different material) which is nevertheless inserted in the casing together with the elements formed in a single unit with the casing or a part thereof.

A part of the casing (for example one of the bowls 5) may itself be formed so as to constitute a component of the gift. For example, if the gift represents a small earth-moving vehicle, one of the bowl-shaped bodies 5 may be shaped so as to constitute the body of the vehicle.

It can seen from FIG. 1 that all the components 2, 3 and 4 which are intended to form the gift constitute appendages which extend from the free edge 7 of one of the bowl-shaped bodies 5 by means of thin connecting bridges 8 which can be bent so as to enable the various elements 2, 3 and 4 to be folded into the respective portion of the casing 5.

Figure 2:
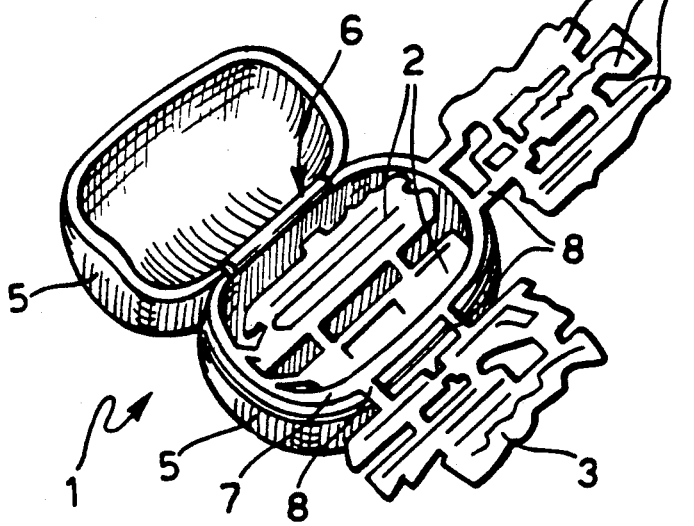
FIGS. 2 to 4 show three successive stages in the packaging of the combination according to the invention for insertion in a chocolate egg or like product.
Figure 3:
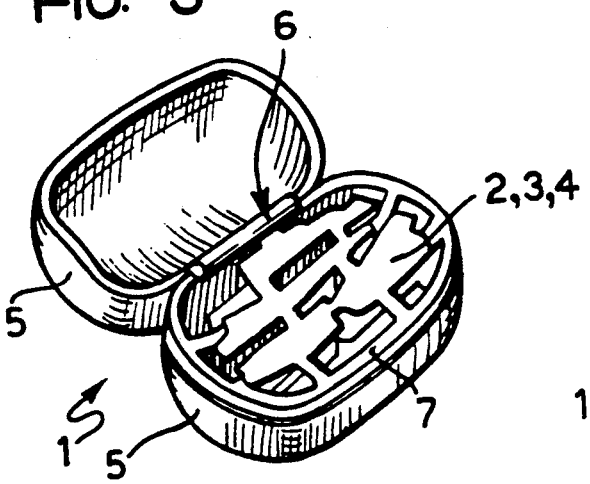
Figure 4:
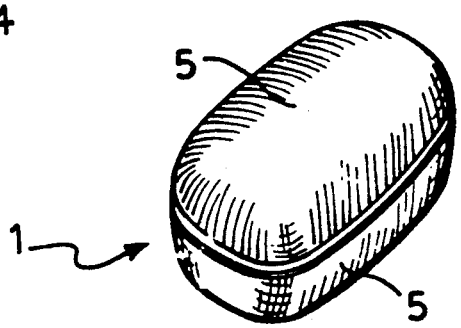

This operation is carried out during the packaging of the combination as shown schematically in FIGS. 2 to 4.

In particular, FIG. 2 shows how the components constituting the gift (which, on formation of the combination as a single unit, for example by means of a moulding operation, extend radially outwardly from the free edge 7) can be folded into the corresponding bowl-shaped body 5.

FIG. 3 shows the stage at which all the appendages constituting the components which are intended to form the gift have been folded or bent into the bowl-shaped body 5.

At this point (possibly after the insertion of further elements, such as a sheet with instructions for the assembly of the gift) the other bowl-shaped body 5 may be folded over to complete the closure of the casing as illustrated in FIG. 4.

At this point the combination, with the gift securely protected by the casing defined by the bowl-shaped bodies 5, can be inserted in the product which is intended to receive it.

The whole packaging operation can be carried out automatically, possibly in a controlled environment.

After removing the combination from the product in which it has been inserted, the user can open the casing by opening out the bowl-shaped bodies 5 and unfolding the components 2, 3 and 4 again.

The latter can then be separated from the bowl-shaped body 5 to which they are connected by the breakage of the connecting bridges 8, and the gift can then be assembled.

As already indicated above, one or more parts of the casing 5 may also be used for this purpose.

Naturally, the principle of the invention remaining the same, the forms of embodiment and details of construction may be varied widely with respect to those described and illustrated, without thereby departing from the scope of the present invention.

What is claimed is:

1. A combination gift and its casing comprising:

a casing;

a gift comprising a plurality of elements;

said gift and said casing being formed essentially as a single unit, said casing comprising two bowl-shaped complementary hollow bodies each having free edges and providing a hollow interior, said gift being physically appended to said free edges and is bendable into and is received into said hollow interior of said bowl-shaped complementary hollow bodies, and wherein said elements are separated from said casing and are assembled together to form said gift.

2. A combination according to claim 1, wherein said casing itself constitutes part of said gift.

3. A combination according to claim 1, wherein said gift is constituted by several components which can be assembled together, said components being formed as appendages of said casing.

4. A method of packaging a combination comprising a gift having a plurality of elements and its casing, comprising the steps of:

(a) forming said gift and its casing essentially as a single unit wherein said casing comprises two bowl-shaped complementary hollow bodies providing a hollow interior and wherein said gift is physically appended to a free edge of said casing;

(b) placing said gift in said hollow interior formed by said two-shaped complementary hollow bodies; and (c) closing said complementary hollow bodies providing said hollow interior around said gift and wherein said elements are separated from said casing and are assembled together to form said gift.

5. A method according to claim 4, further including the steps of forming said gift essentially in the form of appendages of said casing which can be bent into said casing.

6. A combination gift and its casing comprising:

a casing;

a gift comprising a plurality of elements;

said gift and said casing being formed essentially as a single unit, said casing comprising two complementary bodies each having free edges and providing an interior region, said gift being physically appended to said free edges and is bendable into and is received into said interior of said complementary bodies, and wherein said elements are separated from said casing and are assembled together to form said gift.

7. A method of packaging a combination comprising a gift having a plurality of elements and its casing, comprising the steps of:

(a) forming said gift and its casing essentially as a single unit wherein said casing comprises two complementary bodies providing an interior region and wherein said gift is physically appended to a free edge of said casing;

(b) placing said gift in said interior region formed by said complementary bodies; and (c) closing said complementary bodies providing said interior region around said gift and wherein said elements are separated from said casing and are assembled together to form said gift.

8. A combination gift and its casing comprising:

a casing;

a gift comprising a plurality of elements;

a connection means for physically appending said gift to said casing;

said connecting means, said gift and said casing being formed essentially as a single unit, said casing comprising two bowl-shaped complementary hollow bodies each having free edges and providing a hollow interior, said connection means physically appending said gift to said free edges and permitting said gift to be bendable into and to be received into said hollow interior of said bowl-shaped complementary hollow bodies, and wherein said connection means facilitates separating said elements from said casing, said elements being assembled together to form said gift.

* * * * *